US008371228B2

(12) United States Patent
Fichtner et al.

(10) Patent No.: US 8,371,228 B2
(45) Date of Patent: Feb. 12, 2013

(54) FLEXIBLE STEEL SUPPORT FOR A SWITCH ARRANGEMENT IN MAGLEV RAILWAYS

(75) Inventors: Karl Fichtner, Munich (DE); Wolfgang Kirstein, Diedorf (DE); Robert Lippert, Hofgeismar (DE)

(73) Assignee: ThyssenKrupp Transrapid GmbH, Kassel (DE)

( * ) Notice: Subject to any disclaimer, the term of this patent is extended or adjusted under 35 U.S.C. 154(b) by 194 days.

(21) Appl. No.: 12/745,907

(22) PCT Filed: Nov. 28, 2008

(86) PCT No.: PCT/DE2008/001979

§ 371 (c)(1),
(2), (4) Date: Jun. 3, 2010

(87) PCT Pub. No.: WO2009/074130

PCT Pub. Date: Jun. 18, 2009

(65) Prior Publication Data

US 2010/0269728 A1 Oct. 28, 2010

(30) Foreign Application Priority Data

Dec. 11, 2007 (DE) ..... 20 2007 017 388 U

(51) Int. Cl.
*B61B 13/08* (2006.01)
*E01B 7/00* (2006.01)

(52) U.S. Cl. ..... 104/130.02; 246/434

(58) Field of Classification Search ..... 104/130.01–130.06; 246/415 R, 416, 434
See application file for complete search history.

(56) References Cited

FOREIGN PATENT DOCUMENTS

| | | |
|---|---|---|
| DE | 202 08 421 | 10/2003 |
| DE | 20208421 U1 * | 10/2003 |
| DE | 10 2004 015 495 | 10/2005 |
| JP | 55075001 | 6/1980 |

OTHER PUBLICATIONS

"Transrapid MAG-LEV Train the New Dimension of Travel" Dr.-Ing Klaus Heinrich et al, Hestra-Verlag Darmstadt, 1989, pp. 32-35 (With Eng. Transl.).

* cited by examiner

*Primary Examiner* — Robert McCarry, Jr.
(74) *Attorney, Agent, or Firm* — Michael J. Striker

(57) ABSTRACT

The invention relates to a flexible steel support (31) for a switch arrangement in maglev railways. The flexible support (31) contains a hollow profile (32) that extends in a longitudinal direction (x) and a hollow profile that can be bent in a transverse direction (y) and that is provided with lateral sheet metal struts (35) and a top flange (33). The support is also provided with a plurality of cantilever arms (38) that extend in the transverse direction (y), are interspaced in the longitudinal direction (x) and are connected to the sheet metal struts (35) and a plurality of metal cover sheets (42) that are arranged one behind the other in the longitudinal direction (x) and are supported on the cantilever arms (38), the connections between the sheet metal struts (35), cantilever arms (38) and metal cover sheets (42) consisting of welded joints. According to the invention, each cantilever arm (38) has a pressure member (**38*b*) which is connected to a sheet metal strut (35) and projects obliquely upwards and outwards from the latter and a tie (38*c*) formed on said member which projects towards the hollow profile (32) and by means of which the arms are connected to the metal cover sheets (42) and the top flange (33**).

5 Claims, 11 Drawing Sheets

PRIOR ART

PRIOR ART

PRIOR ART

PRIOR ART

FLEXIBLE STEEL SUPPORT FOR A SWITCH ARRANGEMENT IN MAGLEV RAILWAYS

The present invention relates to a flexible support of the type described in the preamble of claim 1.

A known switch system of the type of interest here is composed of a "bending switch" (e.g., "Magnetbahn Transrapid—Die neue Dimension des Reisens" [*Transrapid Mag-Lev Train—The New Dimension of Travel*], Hestra-Verlag Darmstadt 1989, pages 32 through 35, DE 10 2004 015 495 A1). An essential component of a bending switch of this type is a flexible, steel support of the type described above, which is, e.g., 78 m or even longer or shorter, and which carries the track and equipment associated therewith. The flexible support is positioned in a stationary manner at one end, while the rest of the flexible support is supported using a plurality of support frames and wheels mounted thereon such that it may be moved along rails located transversely to its longitudinal direction, which is also the direction of travel, or the x direction. To adjust the switch, the support frames may be moved back-and-forth along the tracks, thereby bending the support in an elastic manner and aligning it with any of several tracks that branch off from the switch. In addition, the support may be composed of a plurality of sections that are interconnected in its longitudinal direction.

The flexible support typically includes, as the base element, a hollow object that is composed of a box profile which has a rectangular cross section, is composed of two lateral sheet metal struts, a bottom flange, and a top flange, and is reinforced by inner cross walls (bulkheads). In addition, the flexible carrier contains cantilever arms (support plates), which are mounted in the extensions of the bulkheads, and metal covers sheets supported on the cantilever arms; various functional parts of the track, such as slider strips, lateral guide rails, and holding elements for the stator cores of an elongated stator-linear motor, or the like, are fastened on the metal cover sheets.

To ensure that the flexible support may be elastically deformed in order to adjust the switch system, the metal cover sheets and the functional parts are composed of subpieces that form individual track elements and are relatively short in the longitudinal direction of the track. The subpieces preferably have a length of, e.g., 2064 mm, which is dependent on the modular dimension of the maglev train, and are separated from each other via narrow gaps that extend transversely to the hollow body. In addition, the metal cover sheets include a number of slots in order to prevent them from warping or folding perpendicularly to their top surface, i.e., in the z direction, when the flexible support undergoes elastic bending, that is, a reduction in stiffness and load on the switch about the z axis is attained.

A problem that has not been completely solved are the various welded joints that are used with a flexible support of this type, and via which the sheet metal struts, cross walls, cantilever arms, metal cover sheets, and top flanges are interconnected. The welds, e.g., that connect the cantilever arms and bulkheads to the sheet metal struts, and on which practically the entire track is supported, form "cross joints" which undergo great loads mainly in the elastically deformed state of the flexible carrier and when a vehicle passes over, and which limit the endurance limit of the flexible support. Fatigue cracks will therefore appear first in these welds. In the case of 3-way switches in particular, the forced deformations and the vehicle operation result in high stress amplitudes that increase the risk of fatigue even further. It is also disadvantageous that a portion of the welds cannot be easily seen or accessed from the outside. This applies, e.g., for the connections between the top flange and the metal cover sheets, and for the connections—which terminate near the top flange—between the sheet metal struts and the inner edges provided on the cantilever arms. It is therefore not possible to inspect, and repair, if necessary, welds that are present there, using the crack detection methods and equipment that are typically used in structural steel engineering. Finally, it is difficult to identify unambiguous notches, thereby making it nearly impossible to reliably calculate the service life of the switch construction, and so a reduced service life must be assumed, for safety reasons.

Proceeding therefrom, the present invention addresses the technical problem of improving the flexible support of the type described initially in a manner such that it has increased fatigue strength and makes possible a larger number of switch displacements and vehicle passages.

This problem is solved, according to the present invention, via the characterizing features of claim 1.

The basic point of the present invention is considered to be that each of the cantilever arms is subdivided into a brace and a tie. As a result, it is possible to distribute the forces resulting from the vehicle operation and the forced deformation into tensile forces, which only mainly act on the ties and in the y direction, and into compression forces, which only mainly act on the braces and primarily in the z direction. Therefore, these forces no longer need to be absorbed solely by the inner edges and the welds that connect them to the sheet metal struts. Furthermore, the present invention makes it possible to situate the inner edges of the braces and the ends of the ties, which are connected to the top flanges, such that they are interspaced with adequate clearance. As a result, welds that are neither visible nor accessible are largely prevented. In addition, the load-bearing welds in particular, which are at risk of fatigue, may be situated such that they are easily visible and are accessible, if necessary, from the outside more easily than before. Due to the reduction of loads in the region of the cross joints, it is also possible to identify more favorable cases of notches, i.e., the welds may be designed such that notches defined in hollow tiles are easily identified. In all, the present invention therefore results in reduced stresses in the welds, increased fatigue strength, and a longer service life of the entire switch system.

Further advantageous features of the present invention result from the dependent claims.

The present invention is explained below in greater detail with reference to the attached drawings of an embodiment. In the drawings.

Figure 1:
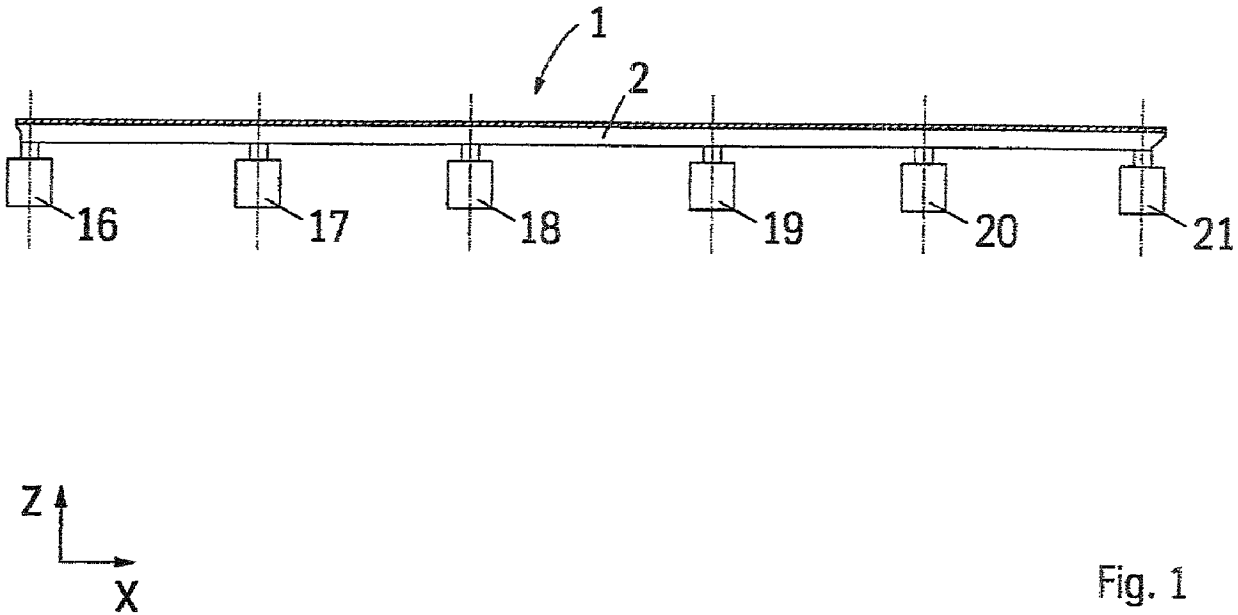
FIGS. 1 and 2 show a schematic side view and a top view, respectively, of a known switch system, which is designed for use with maglev trains, including a flexible support.
Figure 2:
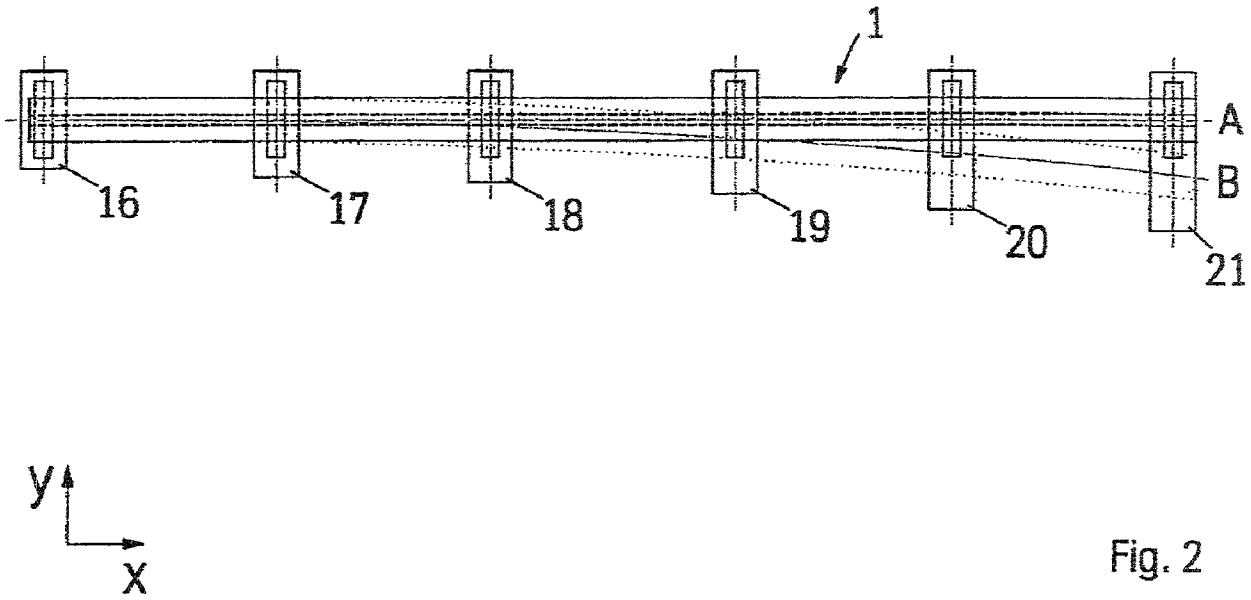
Figure 3:
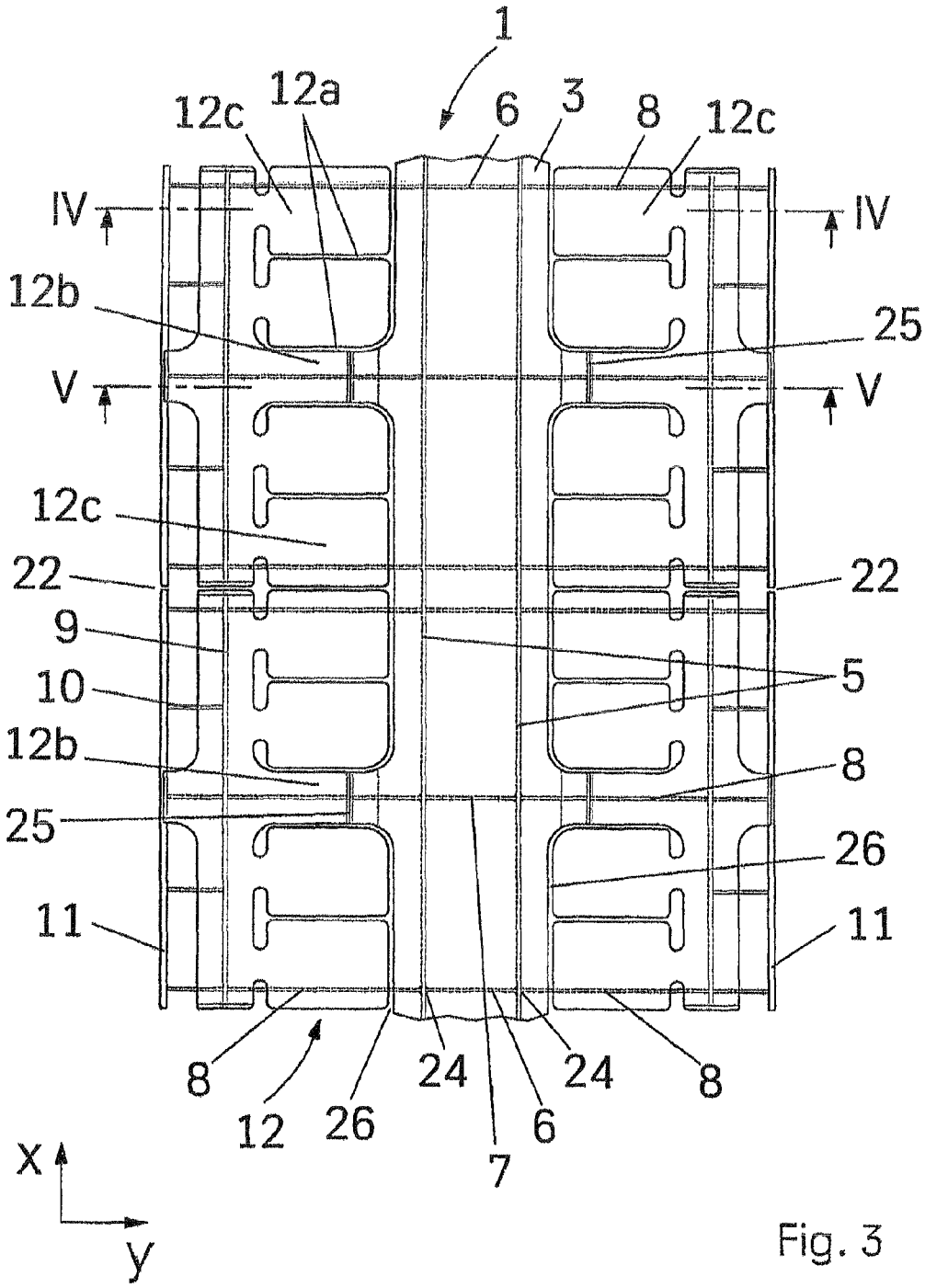
Fig. 3 PRIOR ART
FIG. 3 shows a schematic top view of the flexible support and equipment parts—fastened thereon—of the switch system shown in FIGS. 1 and 2.
Figure 4:
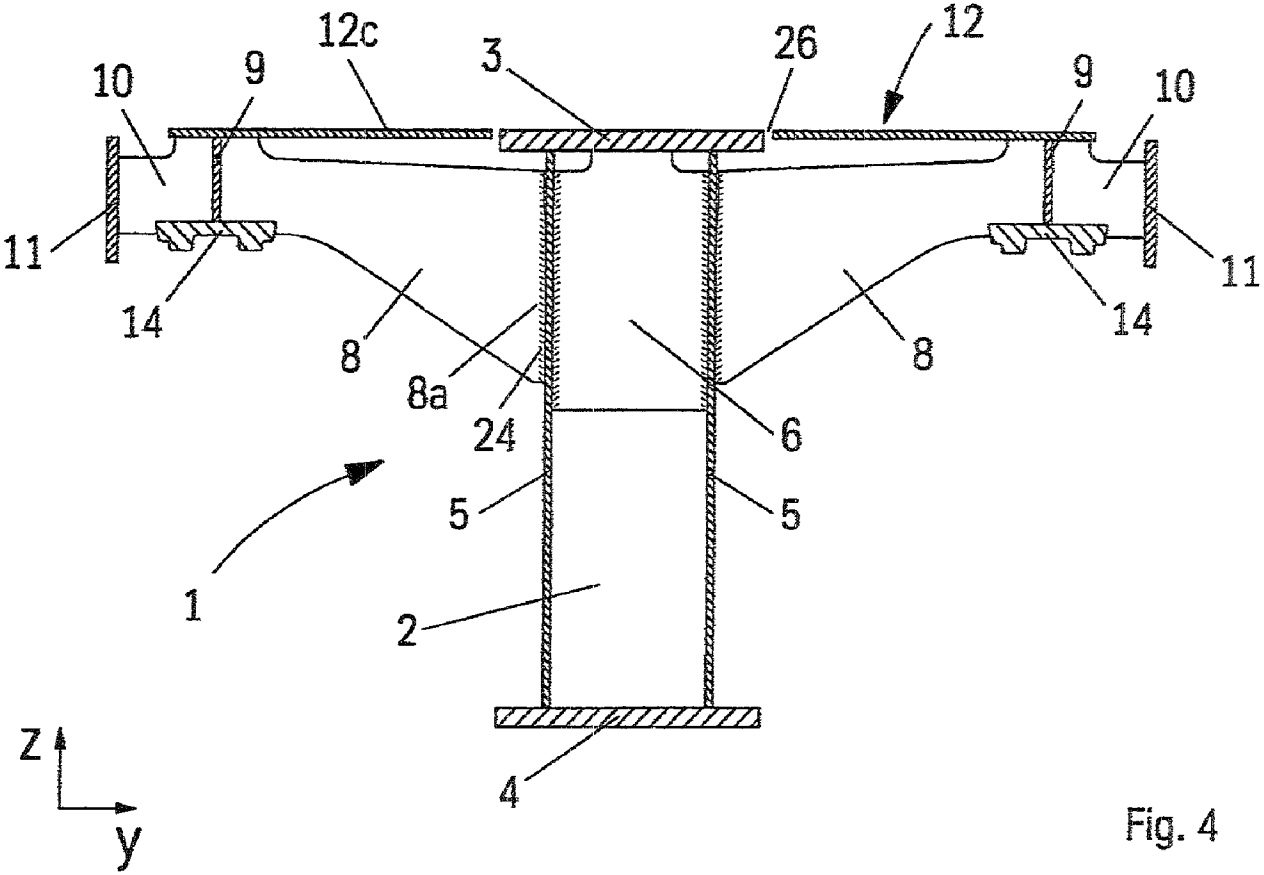
FIGS. 4 and 5 show cross sections along lines IV-IV and V-V in FIG. 3.
Figure 5:
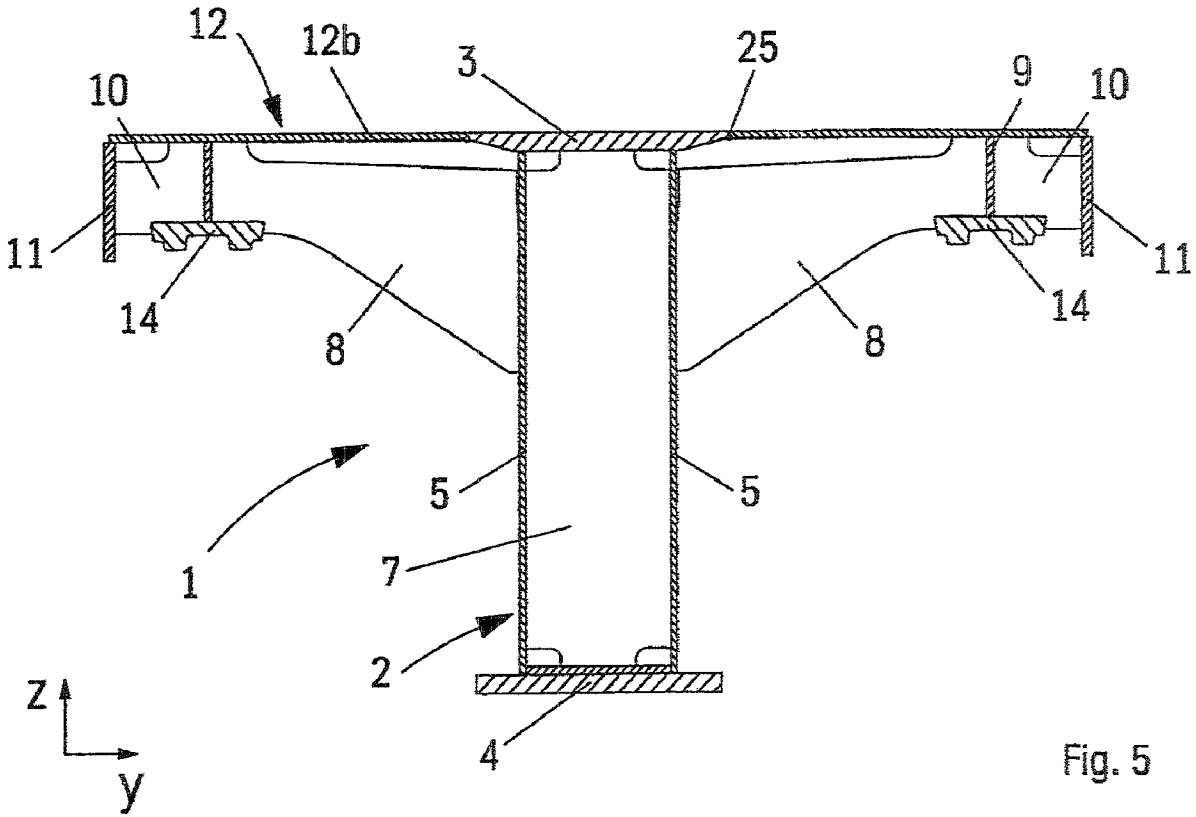

According to FIGS. 1 through 5, a typical switch system in the form of a bending switch for maglev trains includes a flexible support 1 that is composed of steel and extends along the entire length of the switch, e.g., it is approximately 78 m long. Flexible support 1 contains a support element, which extends in a longitudinal or traveling direction (=x direction), in the form of a hollow profile 2 which preferably has a box profile with a rectangular cross section; in this case, the height, which extends perpendicularly to the x direction and parallel to the z direction of an imagined coordinate system, is greater than the width. As shown in FIGS. 4 and 5, hollow profile 2 is formed of a top flange 3, a bottom flange 4, and two lateral parts of sheet metal struts 5 that connect the two and, in the installed state, are situated substantially vertical and perpendicular to top flange 3 and bottom flange 4. Cross walls and bulkheads 6 and 7, which are used for reinforcement, are provided between sheet metal struts 5; according to FIGS. 4 and 5, bulkheads 6 extend, starting at top flange 3, across approximately half the height, and bulkheads 7 extend across the entire height of hollow profile 2. In addition, support plates or cantilever arms 8 are fastened to each sheet metal strut 5 and project perpendicularly away therefrom in the y direction, to the right or left, and on the ends of which segments 9 are fastened. Ribs 10, which are situated parallel to cantilever arms 8 and preferably in their extensions (y direction), are fastened to segments 9; equipment parts 11 in the form of lateral guide rails that are used for track-following by the vehicles are mounted to the outer end faces of ribs 10. In the embodiment, a lateral guide rail is provided on each longitudinal side of flexible support 1, and the configuration is preferably mirror-symmetrical to the xz plane of the imagined coordinate system.

Metal cover sheets 12 are supported on the top sides of cantilever arms 8, on both sides of hollow profile 2 and in a symmetric configuration, it being possible to fasten further, not-depicted equipment parts in the form of slider strips to metal cover sheets 12; slider strips are used to set down the vehicle and, similar to equipment parts 11, extend along the entire length of flexible carrier 1. Finally, flexible support 1 is provided with equipment parts 14 in the form of stator carriers on the underside of segments 9; equipment parts 14 are used, e.g., to fasten stator cores of an elongated stator-linear motor.

Parts 1 and 14 that are described are composed of steel and are non-detachably interconnected via welding, to form flexible support 1 shown in FIGS. 1 through 4.

As shown in FIG. 2, flexible support 1 is bent continually by a maximum of, e.g., approximately 3.65 m to adjust the switch system from a continuous track A to a branching-off track B. To this end, flexible support 1 is supported, e.g., on six supports 16 through 21, and is fixedly connected to a first support, which is support 16 in this case, while it may be moved back and forth on other supports 17 through 21 in a known manner transversely to the longitudinal direction, i.e., in the y direction and substantially horizontally.

Equipment parts 10 and 14 that are shown in FIGS. 4 and 5, and metal cover sheets 12 do not bend along with hollow profile 2 when the switch system is actuated. Instead, they are composed of sections that are, e.g., only approximately 2 m long, are situated one behind the other in the x direction in the installed state, and are interspaced by narrow gaps 22 (FIG. 3), so that they are automatically situated along a polygon outline when hollow profile 2 bends. In addition, metal cover sheets 12 are advantageously provided with slots 12*a* that extend parallel to the x and y axis in order to facilitate the bending of hollow profile 2, and to prevent metal cover sheets 12 from warping or folding in the z direction, as could happen due to their being coupled to cantilever arms 8.

Switch systems that include flexible supports 1 of the type described herein are generally known to a person skilled in the art, e.g., from DE 202 08 421 U1 and DE 10 2004 015 495 A1 which are hereby made the subject matter of the present disclosure via reference, in order to avoid repetition.

The problems associated with flexible support 1, which are described above, mainly result due to welds—some of which are labelled using reference numeral 24—in the region of the cross joints between the inner and outer sides of sheet metal struts 5, bulkheads 6, 7, and inner edges 8*a* of cantilever arms 8. Welds 24 support cantilever arms 8 and equipment parts 11 and 14 connected thereto, and the loads that occur when a vehicle passes. Metal cover sheets 12 are likewise supported nearly exclusively on cantilever arms 8, and are likewise connected to hollow profiles 2 and top flanges 3 along short center segments 12*b* and with the formation of additional welds 25 (see FIGS. 3 and 5). End sections 12*c* of metal cover sheets 12, each of which is likewise connected to an assigned cantilever arm 8, are not connected to hollow profile 2, however, but instead are separated from it via further gaps 26 (FIGS. 3 and 4). Welds 25 and the top ends of welds 24 of cross joints are not visible and accessible from all necessary sides, which makes it difficult or impossible to perform necessary maintenance and repair work.

In contrast, a flexible support 31, according to the present invention and as shown in FIGS. 6 through 11, includes a hollow profile 32, as usual, which is composed of a top flange 33, a bottom flange 34, sheet metal struts 35, and bulkheads 36, 37, and also includes cantilever arms 38 to which segments 39, ribs 40, equipment parts 41, metal cover sheets 42 that are provided with slots 42*a*, center sections 42*b*, and end sections 42*c*, and equipment parts 44 are fastened, but the designs of cantilever arms 38 and metal cover sheets 42 are different.

Figure 6:
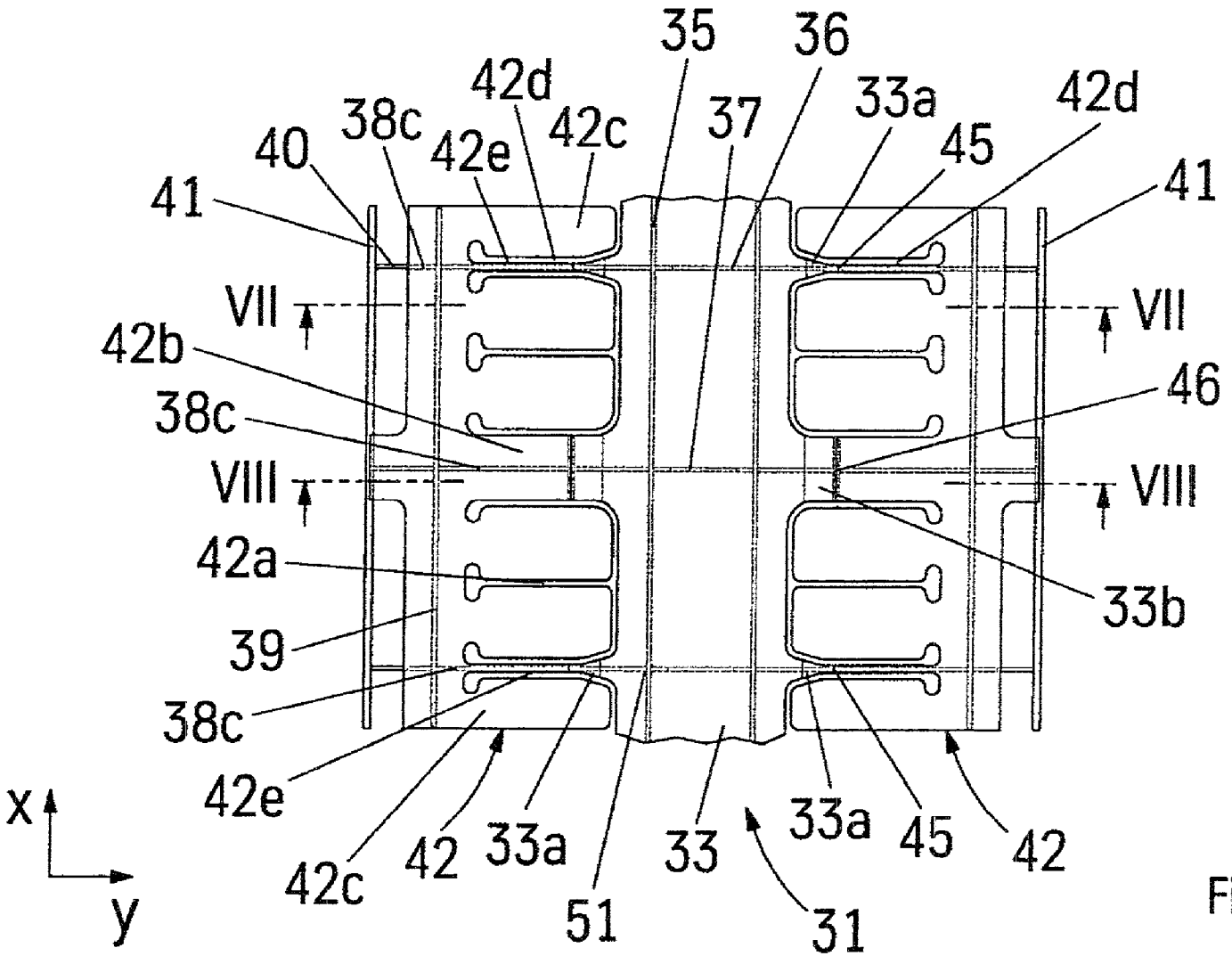
FIG. 6 shows a schematic top view based on FIG. 3 of a flexible support according to the present invention.
Figure 7:
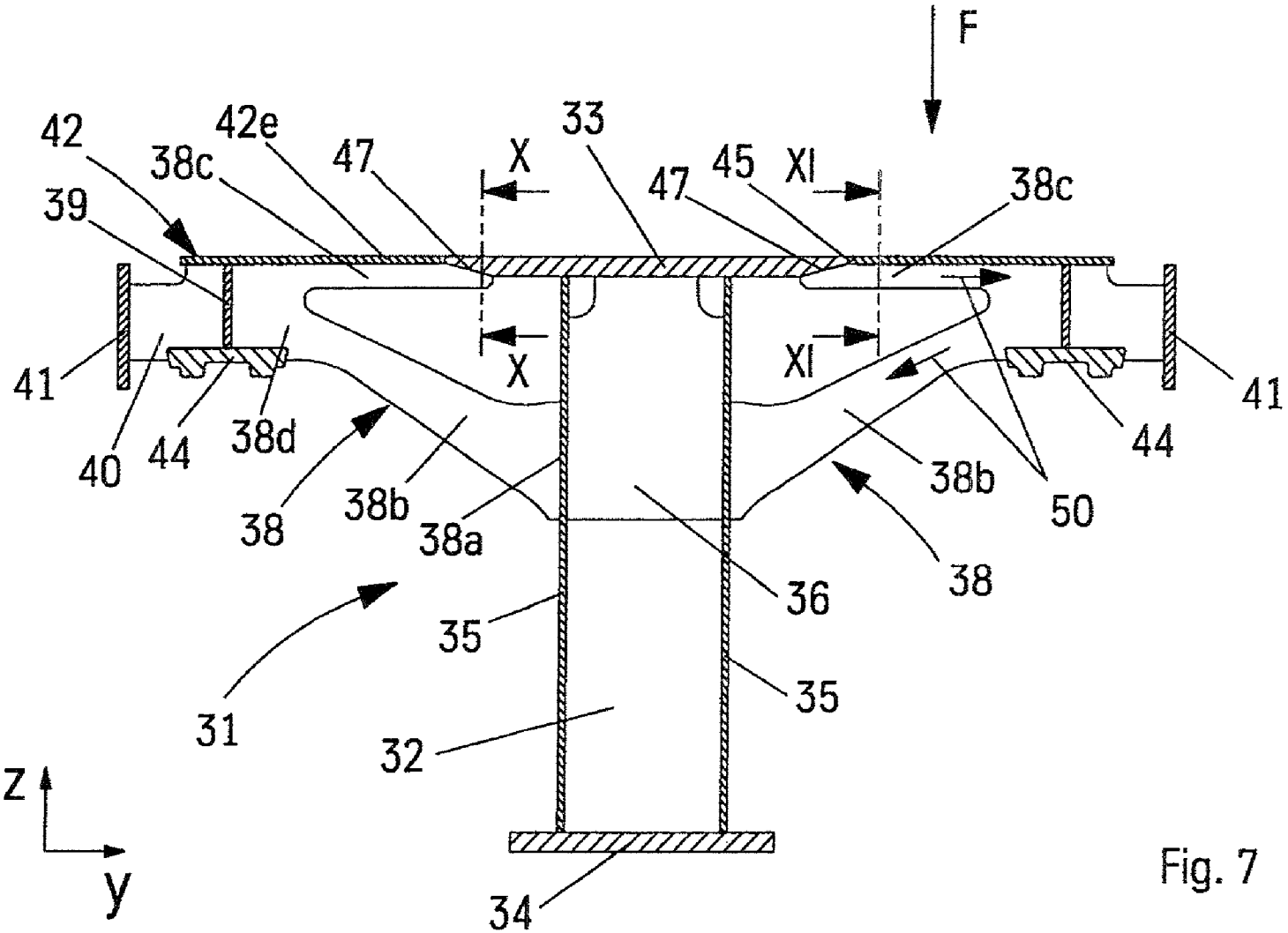
FIGS. 7 and 8 show cross sections along lines VII-VII and VIII-VIII in FIG. 6.
Figure 8:
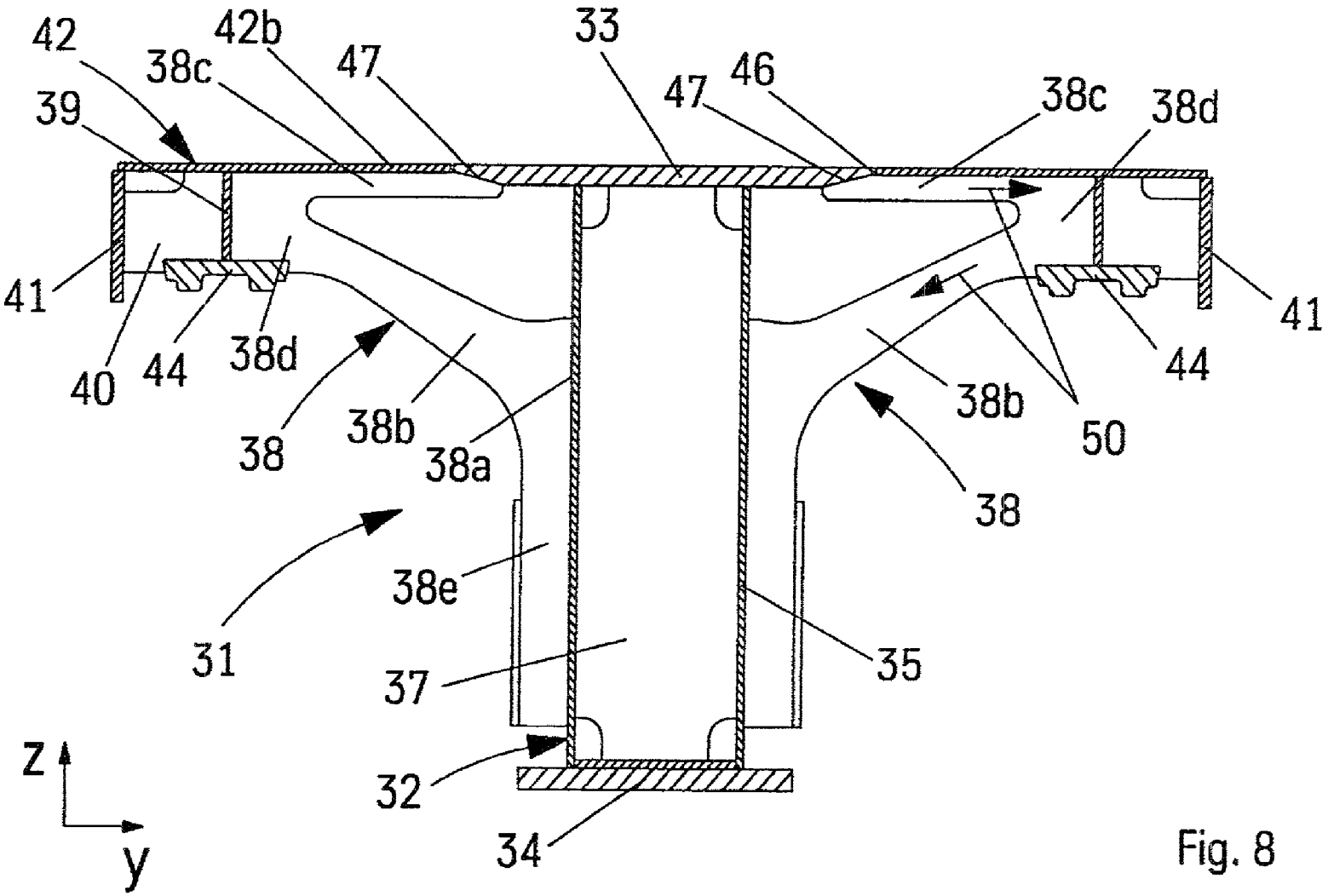

As shown in FIGS. 6 through 8 in particular, although FIG. 6—in contrast to FIG. 3—shows only one metal cover sheet 42 on either side of hollow profile 32, cantilever arms 38 include two sections that transition into each other, one lower section of which is formed as a brace 38*b* that is provided with an inner edge 38*a*, and one upper section of which is formed as a tie 38*c*. Brace 38*b* is connected via its inner edge 38*a* to an associated sheet metal strut 35, and is joined thereto via welding. Brace 38*b* extends obliquely upwards and outwards from inner edge 38*a* and, therefore, from hollow profile 32, to a transition region 38*d* which is welded together with segment 39. Tie 38*c* is formed on transition region 38*d*, and extends from there substantially in the y direction and toward hollow profile 2, and forms an acute angle with brace 38*b*. As shown in FIG. 6, parts 38*a* through 38*d* are preferably provided on a plane-parallel sheet-metal part that is manufactured as a single part. In addition, a comparison of FIGS. 7 and 8 shows that braces 38*b* that are supported on a bulkhead 6 that extends across approximately half the height of hollow profile 2 terminate at a correspondingly short inner edge 38*a* (FIG. 7), while braces 38*b* that abut a bulkhead 37 that extends substantially along the entire height of hollow profile 32 are provided with an extension 38*e* that extends in the z direction, and therefore include a correspondingly elongated inner edge 38*a* (FIG. 8) that extends to the vicinity of bottom flange 4.

Figure 9:
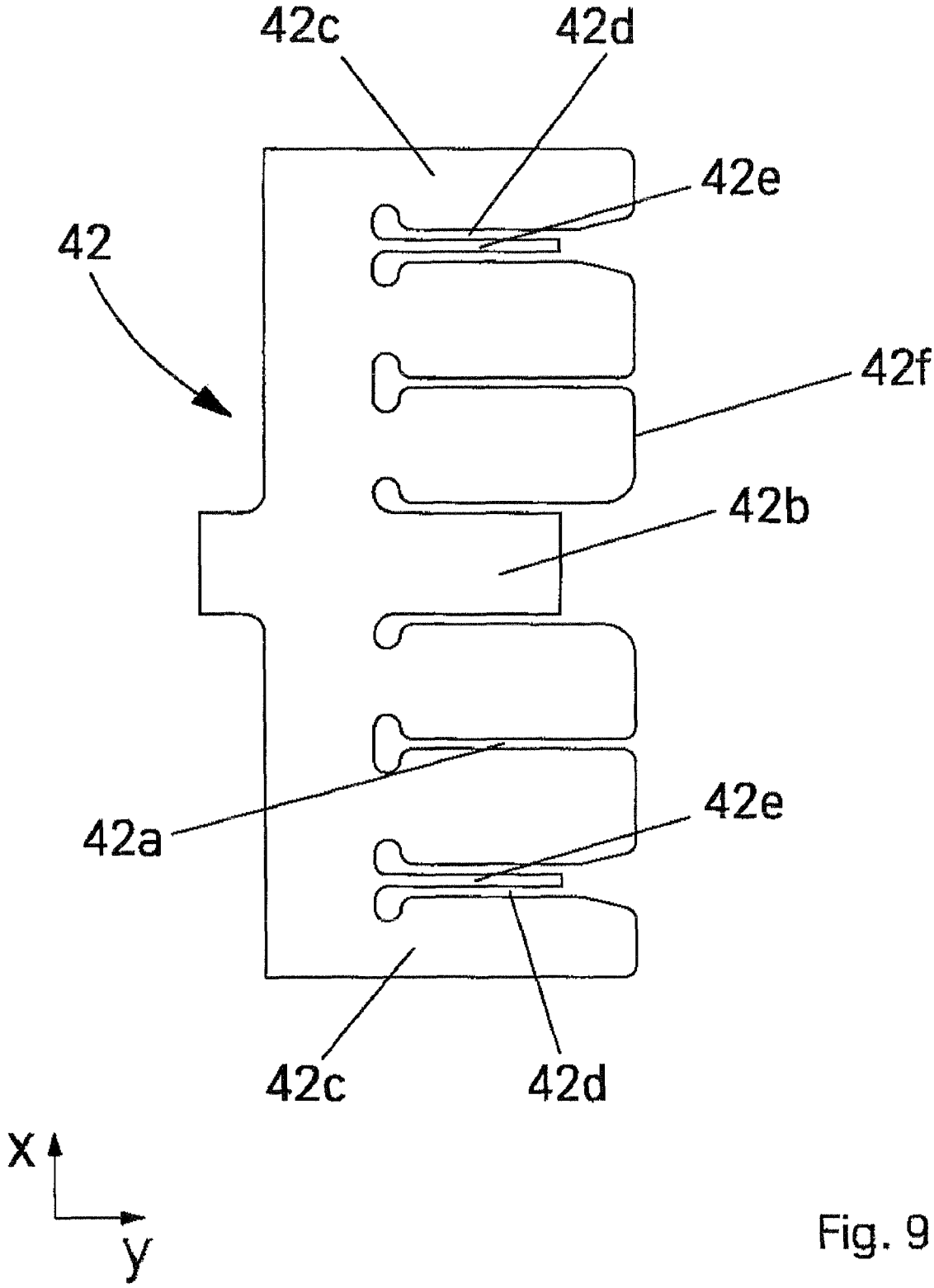
FIG. 9 shows a top view of an individual metal cover sheet of the flexible support shown in FIG. 6.

According to an embodiment that is particularly preferred and has been considered to be the best embodiment of the present invention, and as shown in FIG. 9 in particular, in an individual depiction of the left-hand metal cover sheet shown in FIG. 6, each metal cover sheet 42 is provided, in the region of its two end sections 42*c*, with a recess 42*d* that is open toward hollow profile 32, and into each of which a beam tie

42*e* extends that is integrally formed on metal cover sheet 42 and extends substantially in the y direction.

Due to the differences from the prior art that are described herein, a design that is otherwise largely analogous to FIGS. 1 through 5 results in the connections of cantilever arms 38 and metal cover sheets 42 to each other and to top flanges 3 and sheet metal struts 35, the connections being created via welds and being shown in FIGS. 6 through 11:

1. The outer sides of sheet metal struts 35 are connected only to inner edges 38*a* of braces 38*b* of cantilever arms 38.

2. Cantilever arms 38 (FIGS. 6 and 7) that are assigned to end sections 42*c* of metal cover sheets 42 are fastened via ties 38*c* to the undersides of beam ties 42*e* of metal cover sheets 42.

3. Cantilever arms 38 (FIGS. 6 and 8) that are assigned to center sections 42*b* of metal cover sheets 42 are fastened via ties 38*c* to the undersides of center segments 42*b*.

4. The end of center segments 42*b* that face hollow profile 32, and beam ties 42*d* of metal cover sheets 42 are connected along short welds 45 and 46 to top flange 33 of hollow profile 32. For this purpose, top flange 33 is preferably provided with laterally integrally formed shoulders 33*a* and 33*b* that are separated in the x direction by spaces that correspond to the spaces between center segments 42*b* and beam ties 42*e*. In addition, shoulders 33*a*, 33*b* project slightly in the direction of metal cover sheets 42 since the ends of center segments 42*b* and beam ties 42*e* terminate slightly in front of a lateral inner longitudinal edge 42*f* (FIG. 9) of metal cover sheet 42.

Figure 10:
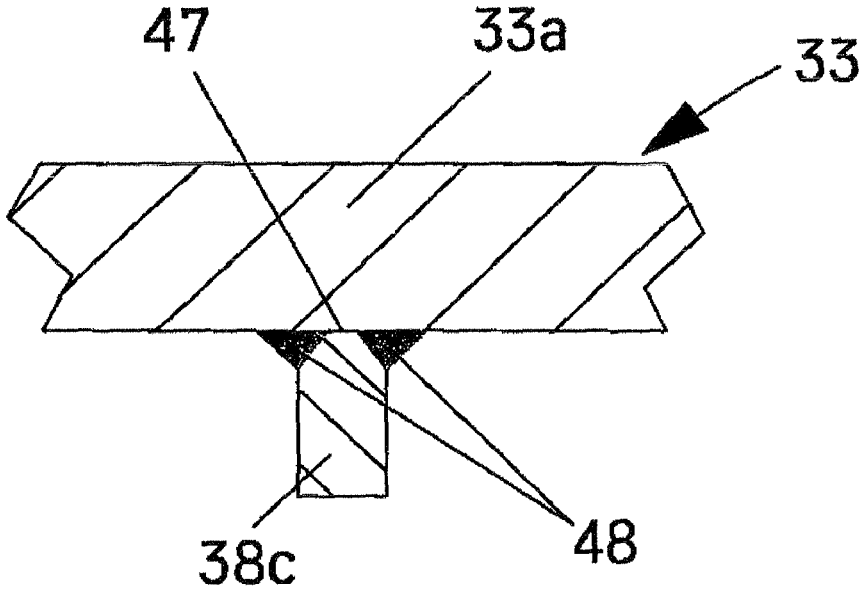
FIG. 10 shows a cross section along the line X-X in FIG. 7, only through a top flange, and ties of a cantilever arm that are connected thereto.
Figure 10:
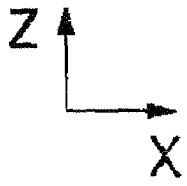
Figure 11:
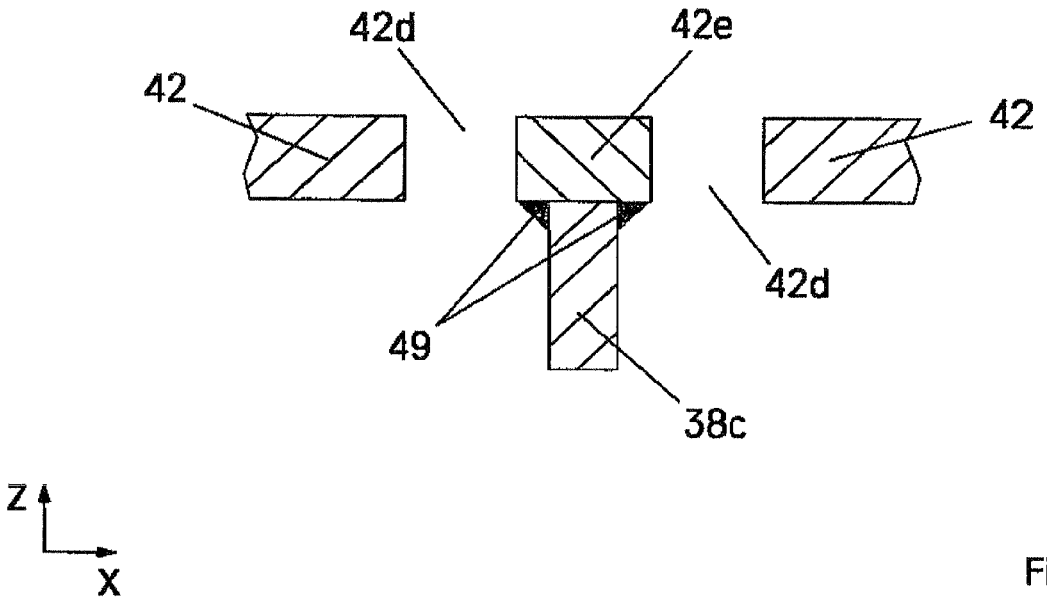
FIG. 11 shows a cross section along the line XI-XI in FIG. 7, only through a beam tie of a metal cover sheet, and ties of a cantilever arm that are connected thereto.

5. Ties 38*c* of cantilever arms 38 are welded via their ends that face hollow profile 32 to top flange 33. For this purpose, shoulders 33*a* and 33*b* are slanted downward or are provided with obliquely extending contact surfaces on their undersides, and the ends of ties 38*b* that face hollow profile 32 are provided with obliquely extending contact surfaces on their top sides, as shown in FIGS. 7 and 8; when flexible support 31 is assembled, the slanted surfaces come into contact with each other and form boundary surfaces 47 that are slanted accordingly. The welding is performed there preferably on both sides of shoulders 33 *a* and 33*b*, as depicted in FIG. 10 in a cross section that only shows tie 38*c* and an associated shoulder 33*a* of the top flange in the region of boundary surface 47, in a greatly enlarged view. Reference numeral 48 labels the welds that are applied here, on either side of shoulder 33*a*.

In contrast, FIG. 111 shows a schematic, enlarged cross section in the region of the connection of a beam tie 42*e* of metal cover sheet 42, and a tie 38*c* of an assigned cantilever arm 38; as shown in FIG. 9, the associated parts of recess 42*d* formed in metal cover sheet 42 are visible on either side of beam tie 42*e*. Welds 49 that extend in the y direction are also indicated.

6. Finally, cantilever arms 38, including their transition regions 38*d* and the outwardly located extensions of ties 38*c*, are welded to the parts of metal cover sheets 42 that lie behind recesses 42*d* and center segments 42*b*, as shown in FIGS. 6 through 8 in particular.

The design of flexible support 32 described herein offers numerous advantages. First, due to the above-described shape of cantilever arms 38, all forces that result from the vehicle operation and the forced deformation and act on the track (e.g., force F in FIG. 7) are distributed onto ties and braces 38*b*, 38*c*, respectively, as indicated by arrow 50 in FIGS. 7 and 8. As a result, welds 51 (FIG. 6), which correspond to welds 24 (FIG. 3) and connect braces 38*d* to sheet metal struts 35 are greatly relieved of stress in the region of the cross joints. Furthermore, it is advantageous that it is possible to situate the load-carrying welds, which include welds 48 and 51 in particular, at a relatively great distance from each other in the z direction. In particular, the distances between the ends of ties 38*c* that face top flange 33, and the ends of inner edges 38*a* of braces 38*b* that are at the top in the z direction, as shown in FIGS. 7 and 8, are preferably selected to be so great that welds 48, 51 are visible from all necessary sides, and they may be accessed easily using typical inspection and repair equipment. As a result, e.g., it becomes easier to repair cracks, or to detect welds. Furthermore, unwanted large notch tensions are prevented, which has a favorable effect overall on the fatigue strength and the calculable service life of the switch system. Furthermore, boundary surfaces 47 may be provided with special curvatures that largely prevent the occurrence of unfavorable notch tensions in these regions. Finally, a further substantial advantage is that a bending of flexible support 31 results in an elastic forced deformation of beam ties 42*e* of metal cover sheets 42, which enhances the flexibility of the bending procedure and reliably prevents metal cover sheets 42 from becoming warped. Independently thereof, the various rail parts are still easily manufactured.

The present invention is not limited to the exemplary embodiment described, which could be modified in various manners. This applies in particular for the shape and size—as shown in FIGS. 6 and 9—of slots 42*a* and recesses 42*d* in metal cover sheets 42, and the connections of metal cover sheets 42 and cantilever arms 38 to equipment parts 41 and 44. Furthermore, the special shape of metal cover sheets 42 and cantilever arms 38 and their braces and ties 38*b*, 38*c*, respectively, are made dependent on the conditions of the individual case. Finally, it is understood that the various features may also be used in combinations other than those described and depicted herein.

What is claimed is:

1. A flexible steel support for a switch system in maglev railways, which contains at least one box-shaped, hollow profile (32) that extends in a longitudinal direction (x), is bendable in a transverse direction (y), and includes lateral sheet metal struts (35) and a top flange (33) connected thereto; the support also includes a plurality of cantilever arms (38) that are interspaced in the longitudinal direction (x), extend in the transverse direction (y), and are connected to outer surfaces of the sheet metal struts (35), and a plurality of metal cover sheets (42) that are situated one behind the other in the longitudinal direction (x), are separated from each other by a narrow gap (22), and are supported on the cantilever arms (38), each metal cover sheet (42) including a center segment (42*b*) that is connected to the top flange (33) and an assigned cantilever arm (38), and two end sections (42*c*), each of which is connected to another assigned cantilever arm (38), the connections between the sheet metal struts (35), cantilever arms (38), and metal cover sheets (42) being formed by welded joints, wherein each cantilever arm (38) includes a brace (38*b*) that is connected to the hollow profile (32) and projects obliquely upwards and outwards from the latter, and a tie (38*c*) that is formed on an outer end of the brace (38*b*), projects toward the hollow profile (32), and via which each cantilever arm (38) is connected to the center segment (42*b*), the end sections (42*c*) of the assigned metal cover sheets (42), and the top flange (33).

2. The flexible support as recited in claim 1, wherein the end sections (42*c*) of the metal cover sheets (42) are provided with recesses (42*d*) that are open toward the hollow profile (32), and with flexible beam ties (42*d*) that extend into the recesses (42*d*), via which the end sections (42*c*) are connected to the ties (38*c*) of the assigned cantilever arms (38), and wherein the beam ties (42*e*) include ends that are connected to the top flange (33).

3. The flexible support as recited in claim 2, wherein the top flange (33) is provided with shoulders (33*a*, 33*b*) that are interspaced in the longitudinal direction (x), and wherein the shoulders (33*a*, 33*b*) connect the top flange 33 to the center segments (42*b*) and beam ties (42*e*).

4. The flexible support as recited in claim 3, wherein the shoulders (33*a*, 33*b*) and the ends of ties (38*c*) facing them are interconnected along slanted contact surfaces.

5. The flexible support as recited in claim 1, wherein the braces (38*b*) include inner edges (38*a*) that are fastened to the sheet metal struts (35), wherein the ends of the ties (38*c*) are connected to the top flange (33), and wherein spaces are provided between the inner edges (38*a*) and the ends of the ties (38*c*) that provide access to the welded joints.

* * * * *